US005549168A

United States Patent [19]

Sadler et al.

[11] Patent Number: 5,549,168

[45] Date of Patent: Aug. 27, 1996

[54] PILE DRIVING APPARATUS

[75] Inventors: Richard A. Sadler, Jacksonville, Fla.; Johannes H. Paffhausen, Fernthal, Germany

[73] Assignee: MGF Maschinen- und Geraete-Fabrik GmbH, Fernthal, Germany

[21] Appl. No.: 383,822

[22] Filed: Feb. 6, 1995

[51] Int. Cl.[6] ..... E02D 7/18

[52] U.S. Cl. ..... 173/49; 173/129; 175/56; 405/232

[58] Field of Search ..... 173/49, 132, 129; 175/56; 405/232

[56] References Cited

U.S. PATENT DOCUMENTS

| | | | |
|---|---|---|---|
| 2,420,793 | 5/1947 | O'Connor | 173/49 |
| 2,886,953 | 5/1959 | Wells . | |
| 3,001,515 | 9/1961 | Haage . | |
| 3,224,514 | 12/1965 | Hornstein et al. | 173/49 |
| 3,394,766 | 7/1968 | LeBelle | 173/49 |
| 3,722,600 | 3/1973 | Hirata et al. . | |
| 3,815,373 | 6/1974 | Giroux . | |
| 4,067,369 | 1/1978 | Harmon | 173/49 |
| 4,603,748 | 8/1986 | Rossfelder et al. | 173/49 |
| 4,730,954 | 3/1988 | Sliwinski et al. . | |
| 4,819,740 | 4/1989 | Warrington | 173/49 |
| 5,234,290 | 8/1993 | Collins . | |
| 5,269,630 | 12/1993 | Bolin et al. . | |
| 5,291,953 | 3/1994 | Mitchhart . | |
| 5,355,964 | 10/1994 | White | 173/49 |
| 5,409,070 | 4/1995 | Roussy | 173/49 |

*Primary Examiner*—Scott A. Smith
*Attorney, Agent, or Firm*—Richard C. Litman

[57] ABSTRACT

A pile driving apparatus including two vibratory hammer units fixed to the top of a support plate having a U-shaped cutout, and a pair of hydraulic clamps fixed to the bottom of the support plate. The support plate is secured to the pile when the hydraulic clamps on the bottom of the support plate engage flanges provided on a hydraulic pile clamp which is clamped to the pile. Hydraulic motors housed within the vibratory hammer units cause the pile to vibrate in a vertical direction, thus gradually driving the pile into the ground. The U-shaped cutout allows the support plate to be positioned on the pile, with the pile passing through the support plate, without having to lift the vibratory hammer and support plate assembly over the top of the pile. This arrangement is particularly advantageous in circumstances where overhanging structures limit the clearance available above the location of the pile. A gate is removably attached to the support plate, across the open end of the U-shaped slot, to add rigidity to the support plate.

12 Claims, 6 Drawing Sheets

PILE DRIVING APPARATUS

BACKGROUND OF THE INVENTION

1. Field of the Invention

The present invention relates to a vibratory hammer pile driving apparatus.

2. Description of the Prior Art

It is commonly necessary in the construction industry to drive piles into the ground at the early stages of the construction process to provide support for the foundation structure. The piles are generally composed of a vertical stack of pipes or "H" beams that are spliced together in an end-to-end relationship. Commonly used pile drivers apply vertical blows to the pile to drive it into the ground. U.S. Pat. No. 2,886,953, issued to Wells, U.S. Pat. No. 3,001,515, issued to Haage, and U.S. Pat. No. , 4,730,954, issued to Sliwinski et al., show this type of pile driver which uses blows to drive the pile. Such pile drivers generally create a considerable amount of noise which creates an environmental nuisance.

To overcome the problems associated with impacting pile drivers, vibratory hammer pile drivers have been introduced. U.S. Pat. No. 3,815,373, issued to Giroux, and U.S. Pat. No. 3,722,600, issued to Hirata et al., show vibratory hammer pile drivers.

The vibratory hammer pile driver of Giroux must be lifted over the top of the pile using a crane, therefore it is not suitable for situations where there is low clearance over the location of the pile. In a low clearance situation, the pile driver of Giroux would necessitate the use of shorter pipe or "H" beam sections resulting in an increased number of splices and an attendant increase in cost.

The vibratory hammer of Hirata et al., although intended for low clearance situations, must still be slipped over an end of a pipe or "H" beam section, because, unlike the present invention, it does not have an open ended slot in the support plate of the vibratory hammer.

U.S. Pat. No. 5,234,290, issued to Collins, shows a hydraulic expander for expanding the opening at the bottom of the bore of a hole for s pier or foundation structure.

U.S. Pat. No. 5,269,630, issued to Bolin et al., shows a hydraulic jack for lifting a concrete slab along a pile inserted through the slab.

U.S. Pat. No. 5,291,953, issued to Mitchhart, shows a device, including a collar and a wedge, for driving square wooden posts into the ground with a manual hammer.

None of the above inventions and patents, taken either singly or in combination, is seen to describe the instant invention as claimed.

SUMMARY OF THE INVENTION

The present invention is directed to a vibratory hammer pile driving apparatus including two vibratory hammer units fixed to the top of a support plate having a U-shaped cutout, and a pair of hydraulic clamps fixed to the bottom of the support plate. A separate, easily manipulated pile clamp is provided which can be secured to the pile. The pile clamp has flanges which can be engaged by the clamps fixed to the bottom of the support plate, thereby securing the entire apparatus to the pile. This arrangement is particularly suited for circumstances where overhanging structures limit the clearance available above the location of the pile.

Accordingly, it is a principal object of the invention to provide a pile driving apparatus that can be mounted on a pile without having to be lifted over the top of the pile.

It is another object of the invention to provide a pile driving apparatus which allows a pile of a given length to have the fewest splices when there is limited overhead clearance above the location of the pile.

It is a further object of the invention to provide a pile driving apparatus which allows the apparatus to be deployed by a standard forklift truck obviating the need for expensive heavy cranes.

Still another object of the invention is to provide a pile driving apparatus having a support plate which has a slot that is open on one side while maintaining sufficient rigidity in the support plate.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
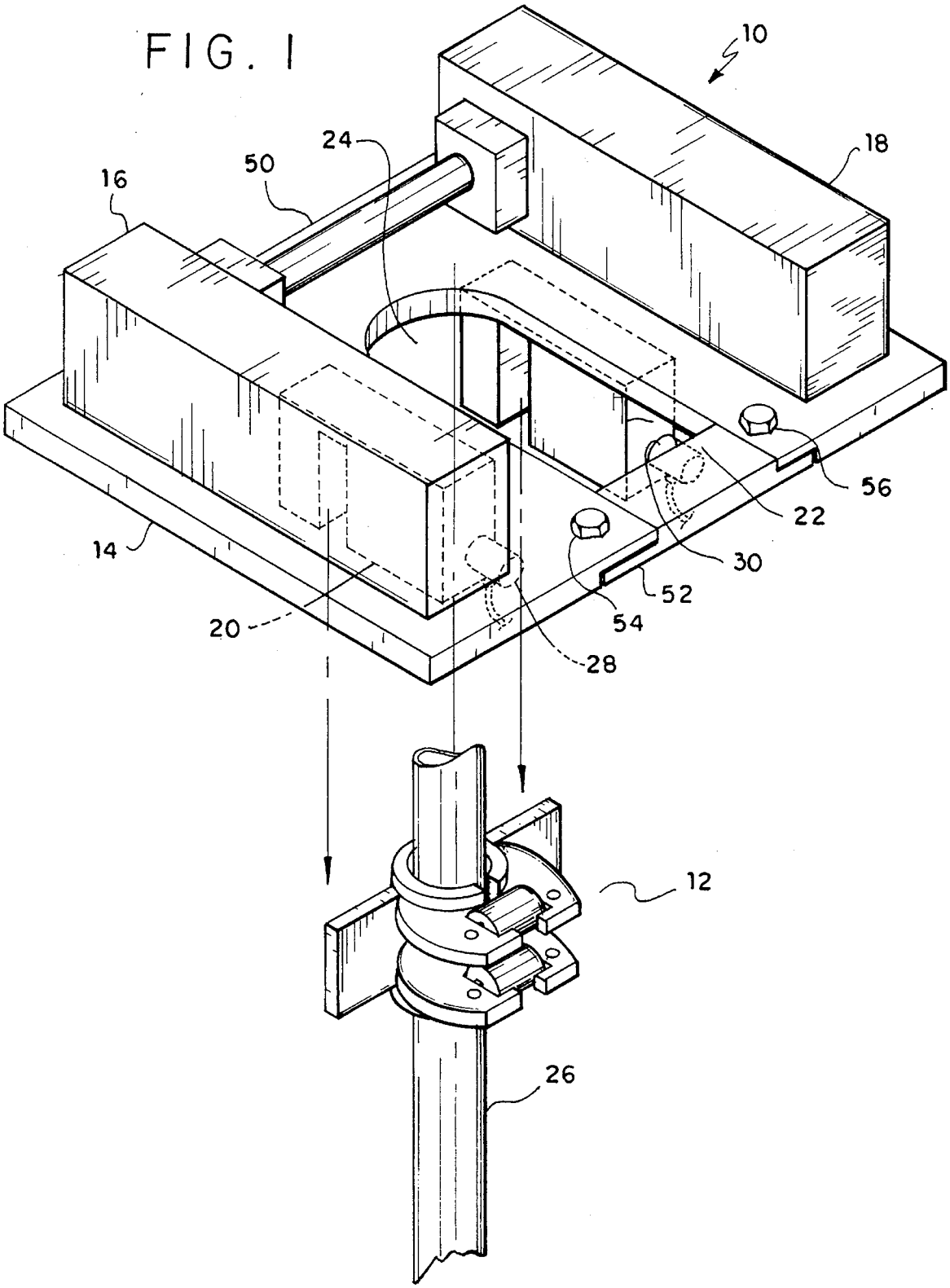
FIG. 1 is a perspective view of the vibratory hammer pile driving apparatus of the present invention.
Figure 2:
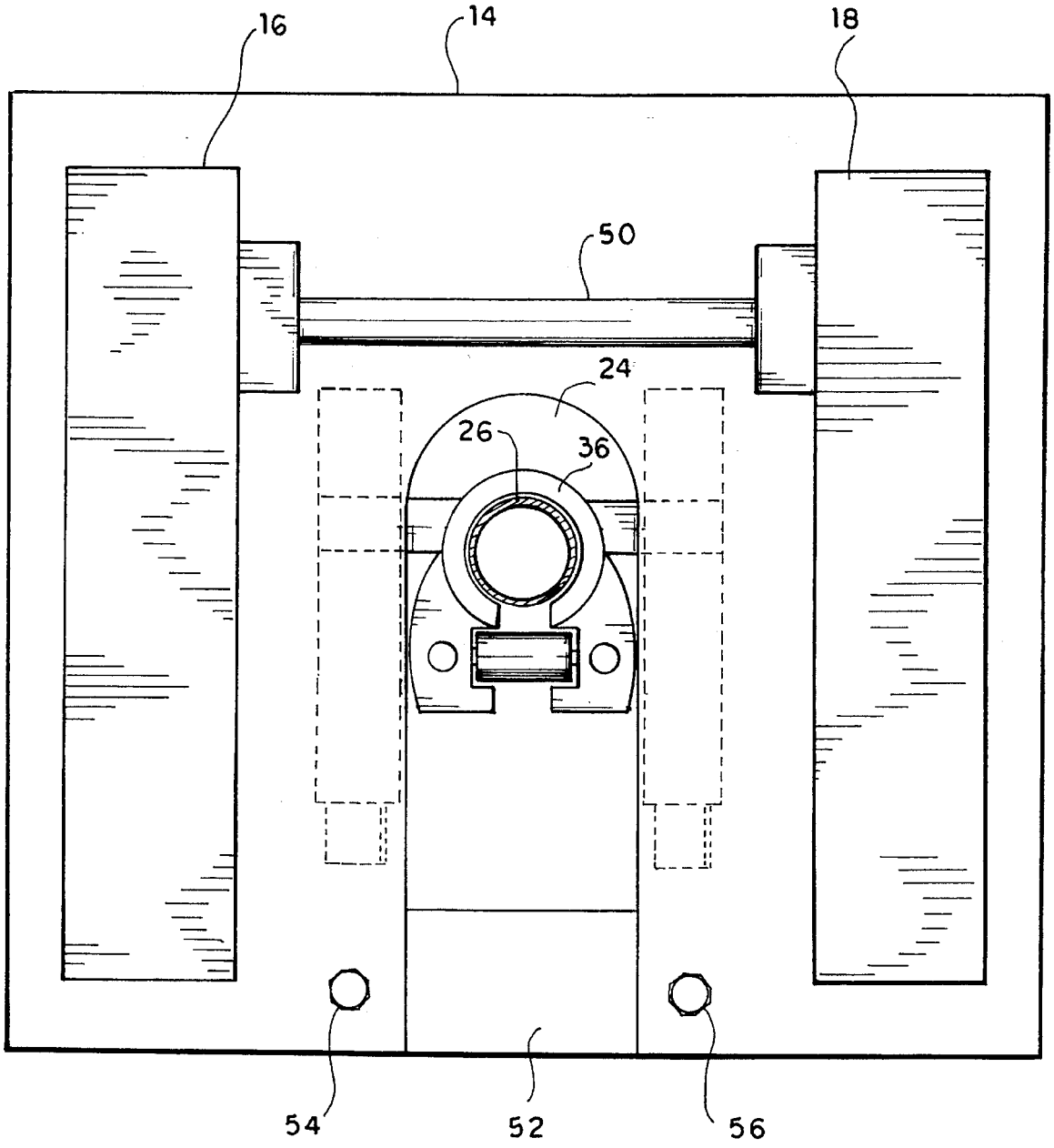
FIG. 2 is a top view of the vibratory hammer pile driving apparatus of the present invention.
Figure 3:
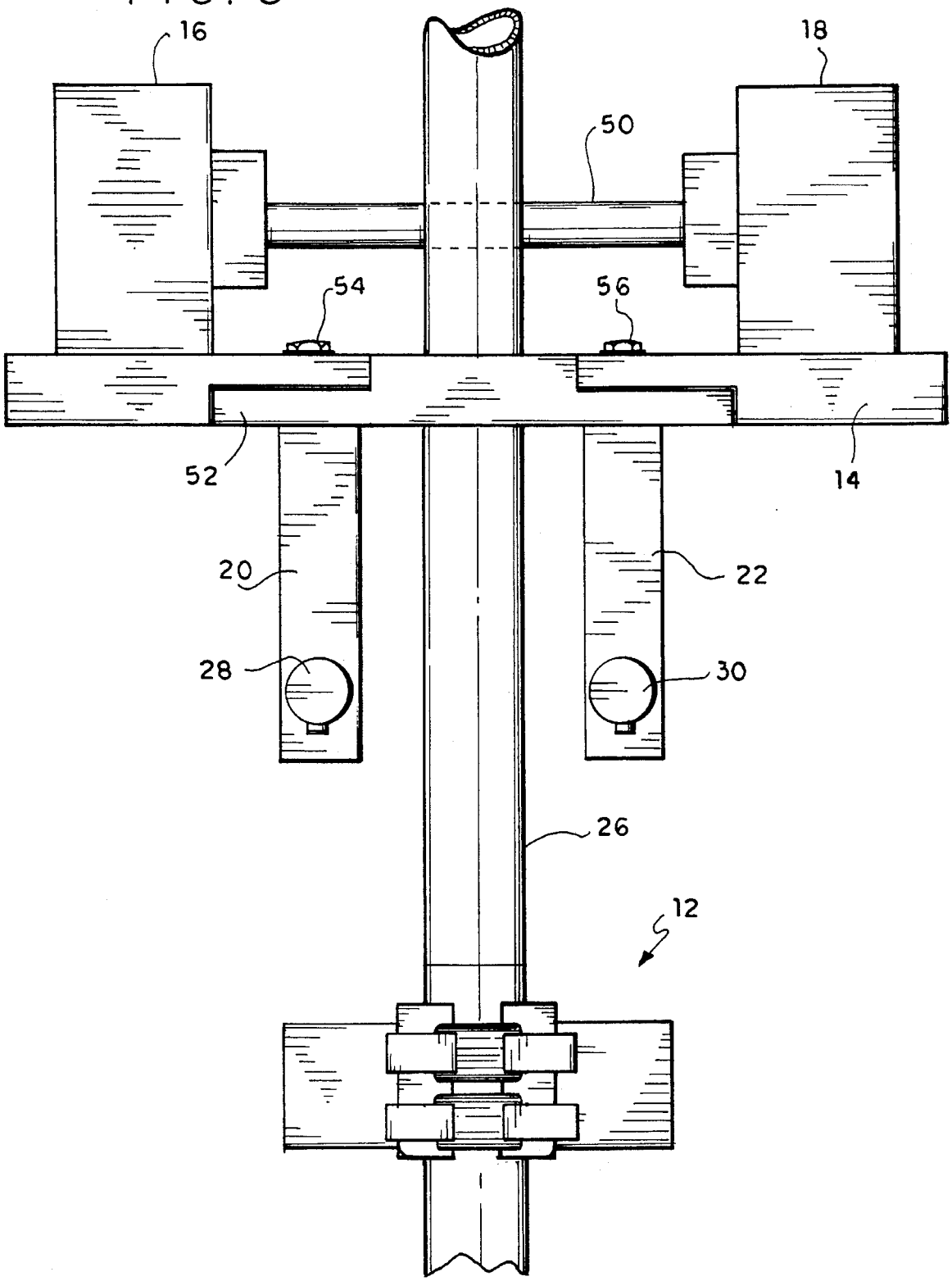
FIG. 3 is a front view of the vibratory hammer pile driving apparatus of the present invention.

Referring to FIGS. 1–6, the present invention is directed to a vibratory hammer pile driving apparatus including a vibratory hammer assembly 10 and a pile clamp 12. The vibratory hammer assembly 10 includes a support plate 14, vibratory hammer units 16 and 18, and hydraulic clamps 20 and 22.

Support plate 14 has an open ended slot 24 which allows the pile 26 to pass through support plate 14 without having to slip plate 14 over an end of a pipe or "H" beam section. The slot 24 is elongated and preferably extends from an edge of the support plate 14 to about the center of the support plate. The intersection of the slot 24 and the edge of the support plate 14 defines the open end of slot 24. The closed end of slot 24 is semicircular in shape giving an overall U-shape to slot 24. The slot 24 should be wide enough to accommodate the diameter of the pipe sections or the width of the "H" beam sections which make up the pile 26. The slot 24 should preferably be long enough to allow the center of gravity of the vibratory hammer assembly 10 to be positioned over the longitudinal axis of the pile 26, although this feature is not strictly necessary. Further, a U-shaped slot is shown in the preferred embodiment as an example only.

Any shape can be used as long as the size requirements mentioned above are met.

Clamps 20 and 22 are fixed to the bottom of the support plate 14 on either side of the slot 24. The clamps 20 and 22 are hydraulically actuated by hydraulic cylinders 28 and 30 respectively. The clamp 20 includes a fixed jaw 32 and a movable jaw 34. The movable jaw slides along a track within the portion of the clamp 20 housing the movable jaw. Hydraulic cylinder 28 provides the motive force for the movable jaw 34. Clamp 22 is identical to clamp 20 and is not shown in detail.

The pile clamp 12 includes a spring steel collar 36, flanges 38 and 40, first and second pairs of brackets 42 and 44, and hydraulic cylinders 46 and 48. The collar 36 has a slit along its length to allow the collar to contract about the pile 26. Each pair of brackets 42 and 44 is symmetrically disposed on either side of the slit in collar 36, and the telescoping hydraulic arms 46 and 48 are secured between the respective pair of brackets 42 and 44. Hydraulic cylinders 46 and 48 act to bring their respective pairs of brackets 42 and 44 together in order to tighten the clamp 12 about the pile 26.

Clamps 20 and 22 are positioned on the bottom of plate 14 so that when the clamp 12 is secured to the pile 26 and the pile 26 is properly positioned within slot 24, the flanges 40 and 38 are vertically aligned with the gaps between the jaws of clamps 20 and 22. The vibratory hammer assembly is then lowered until the flanges 40 and 38 fit within the gaps between the jaws of clamps 20 and 22. Hydraulic fluid pressure in cylinders 28 and 30 then causes the clamps 20 and 22 to tightly grip the flanges 40 and 38 to thereby secure the pile driving apparatus of the present invention to the pile 26.

The vibratory hammer units 16 and 18 house hydraulic motors. The motors cause the rotation of weights which are eccentrically mounted on shafts within the housing. The rotation of the eccentrically mounted weights cause severe vibrations which are transmitted to the pile 26 via clamp 12. The eccentric weights are arranged so that the vibrations are mainly in a vertical direction. Thus the hydraulic motors housed within the vibratory hammer units cause the pile to vibrate in a vertical direction, gradually driving the pile into the ground. Details of the vibratory hammer units are not shown since such units are well known in the art.

A synchronization shaft 50 extending between the two vibratory hammer units, synchronizes the vibrations from each vibratory hammer unit so that the vibrations from the two units do not interfere destructively.

A gate 52 is removably secured to plate 14 by bolts 54 and 56, at the open end of slot 24. The gate 52 functions to restore some of the rigidity of plate 14 which was lost due to slot 24.

Although a spring steel collar 36 is shown in the present example it is also possible to use a two piece collar which has the pieces hinged together.

A remotely located hydraulic pump supplies hydraulic fluid under pressure, via hydraulic lines, to operate the various clamps and motors. The hydraulic pump and associated lines are not shown in the drawings since these are well known in the art.

Figure 4:
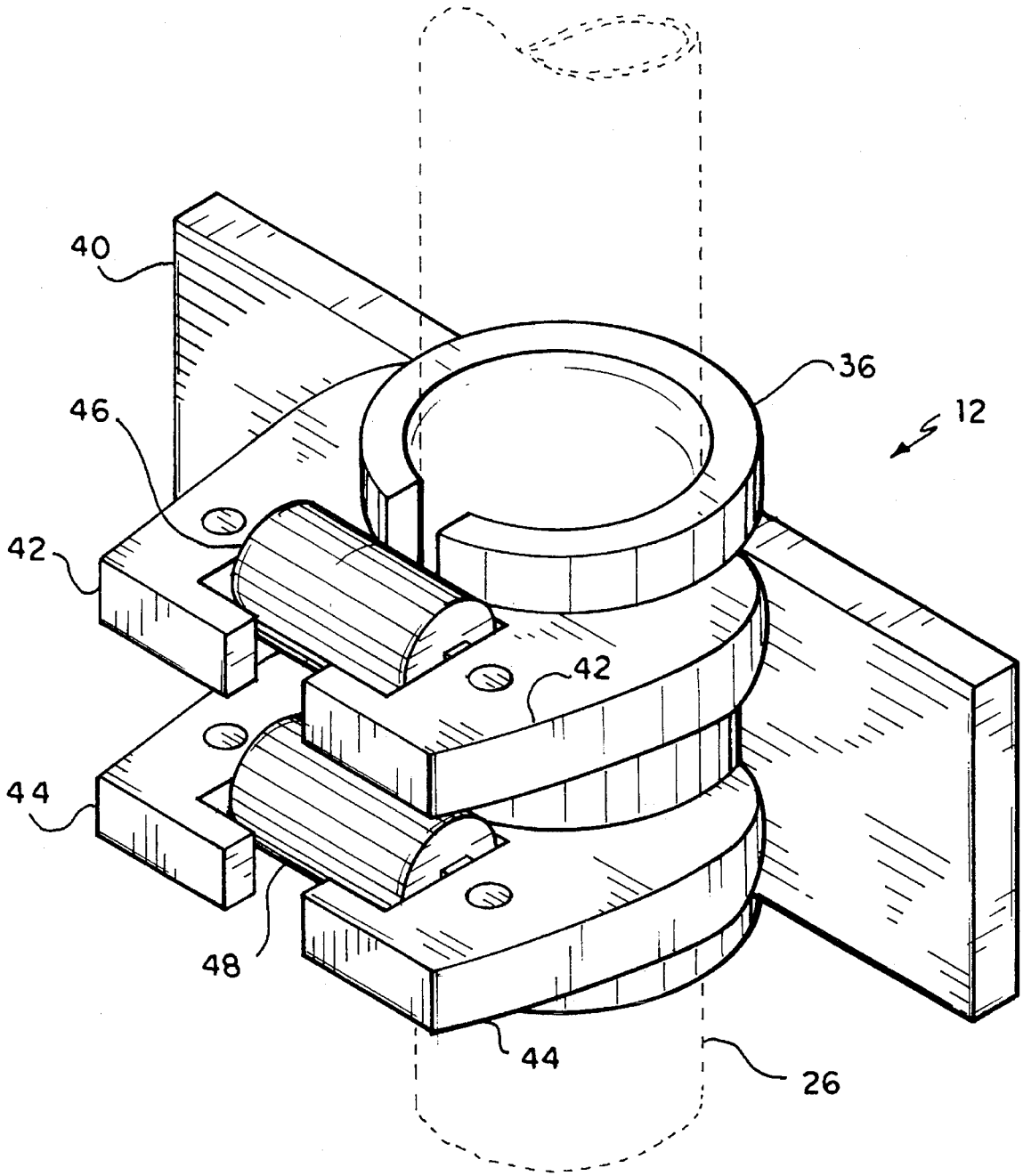
FIG. 4 is a perspective view of the pile clamp for a pile using pipe sections.
Figure 5:
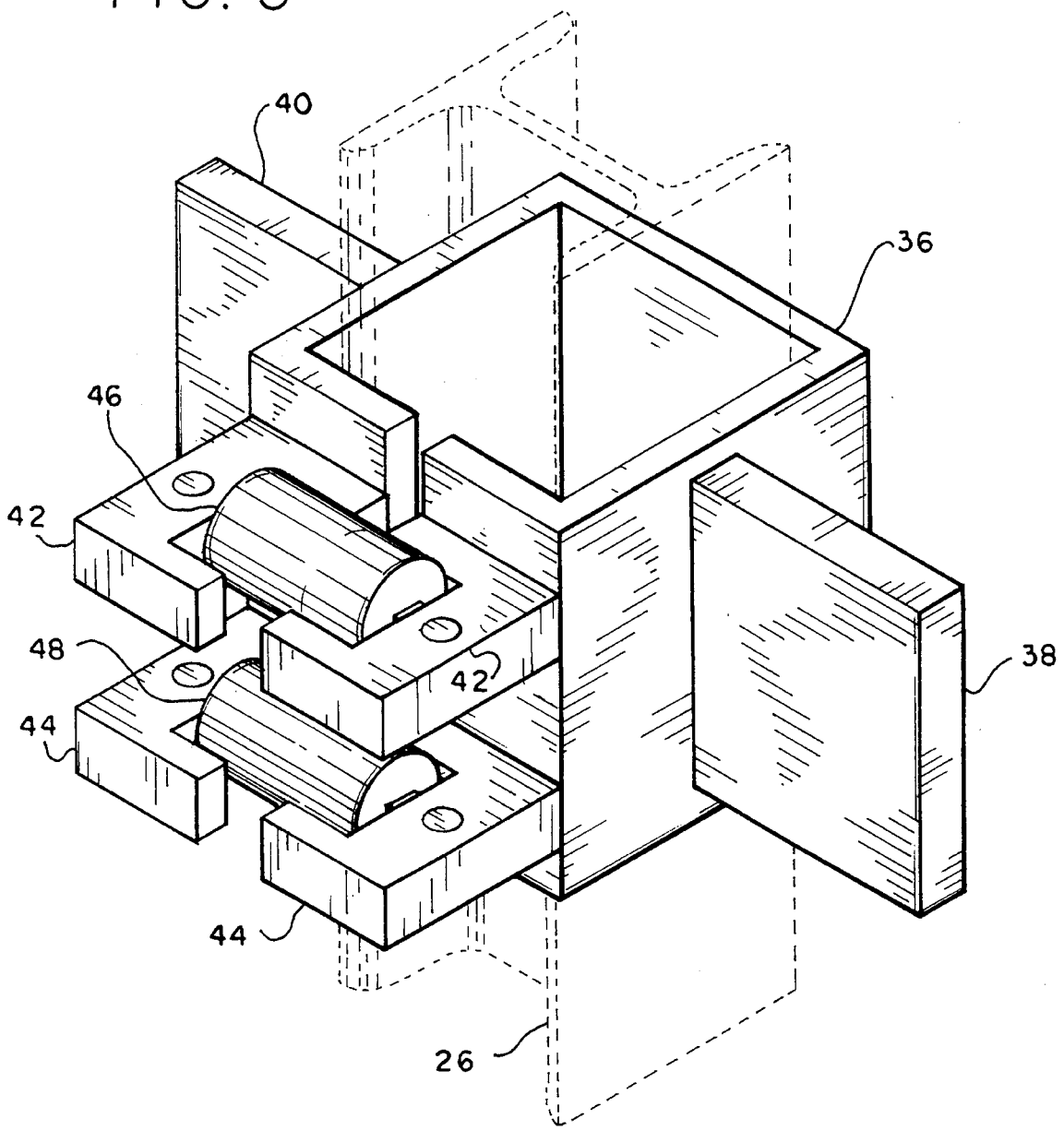
FIG. 5 is a perspective view of the pile clamp for a pile using "H" beam sections.
Figure 6:
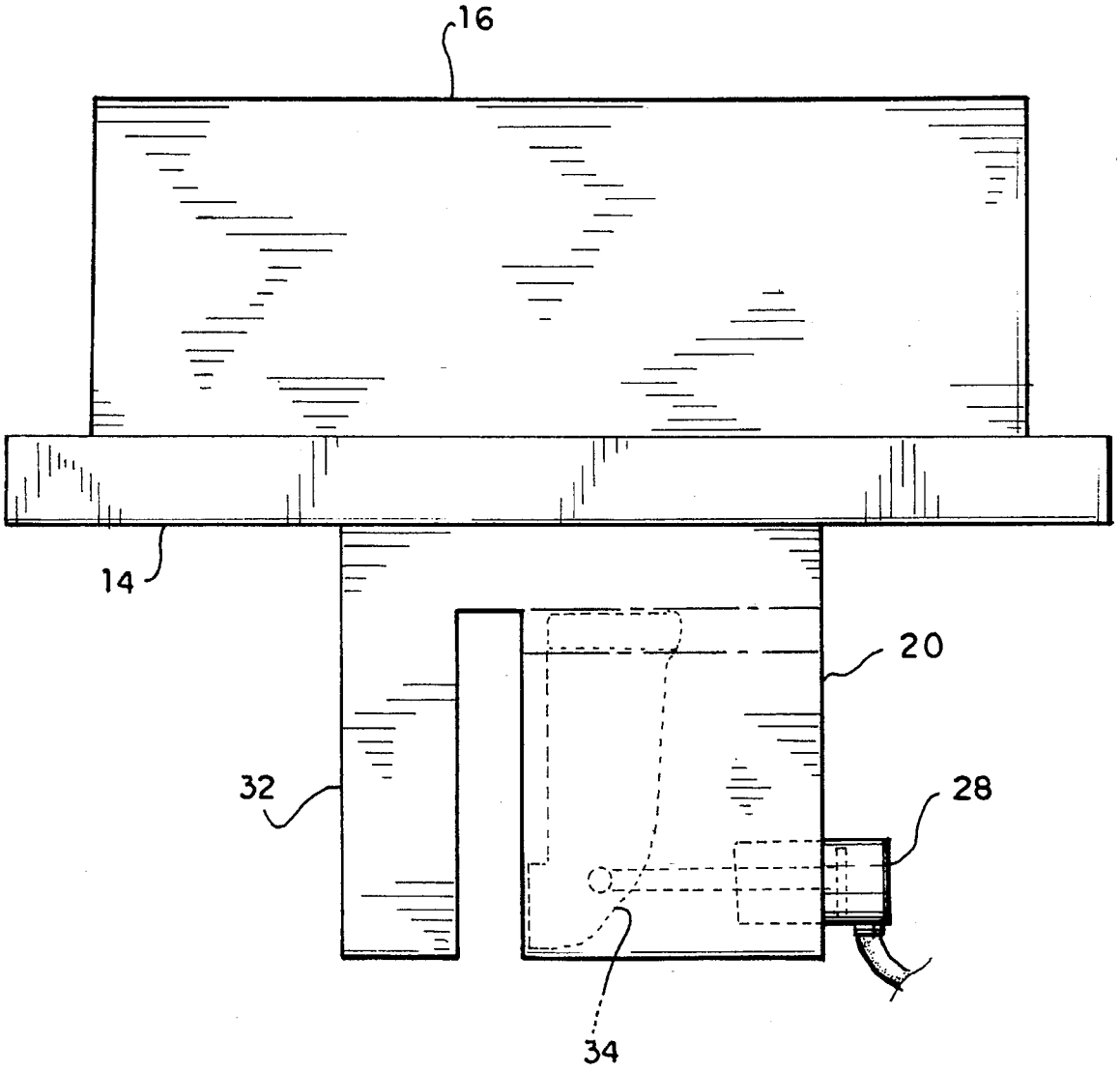
FIG. 6 is a side view of the vibratory hammer assembly.

FIGS. 4 and 6 show pile clamps for use with piles made up of pipes and piles made up of "H" beams respectively. The only difference between the two types of clamps is in the shape of the cross section of the collar 36, the collar 36 being circular in cross section for pipes and rectangular in cross section for "H" beams.

It is to be understood that the present invention is not limited to the sole embodiment described above, but encompasses any and all embodiments within the scope of the following claims.

We claim:

1. A pile driving apparatus comprising:

a vibratory hammer assembly including, a support plate having a center, a top, a bottom, and a slot for allowing said support plate to fit around a pile, at least one vibratory hammer unit fixed to the top of said support plate, at least one clamp fixed to the bottom of said support plate; and a pile clamp having a flange, said flange being engageable by said at least one clamp, whereby said vibratory hammer assembly can be secured to the pile when said at least one clamp is engaged to said flange and when said pile clamp is secured to the pile.

2. The pile driving apparatus according to claim 1, wherein said pile clamp includes:

a spring steel collar having a slit along its length, said collar being capable of fitting around the pile;

first and second pairs of brackets, each pair of said first and second pairs of brackets being symmetrically disposed on both sides of said slit;

a pair of telescoping hydraulic arms secured between a respective pair of said first and second pairs of brackets; and a pair of flanges symmetrically disposed on both sides of said collar, whereby said pair of telescoping hydraulic arms act to force said respective pair of said first and second pairs of brackets together thereby tightening said collar around the pile.

3. The pile driving apparatus according to claim 2, including two clamps fixed to the bottom surface of said support plate and symmetrically disposed on both sides of said slot, said clamps being engageable with respective ones of said pair of flanges.

4. The pile driving apparatus according to claim 3, wherein said slot is U-shaped and extends from a first edge of said support plate to about the center of said support plate.

5. The pile driving apparatus according to claim 4, further including a gate removably attached to said support plate, said gate being positioned to extend across said slot adjacent said first edge of said support plate.

6. The pile driving apparatus according to claim 5, including two vibratory hammer units fixed to the top of said support plate, said two vibratory hammer units being symmetrically positioned on both sides of said slot, and a synchronization shaft extending between said two vibratory hammer units, whereby said vibratory hammer units act in a synchronized manner to vibrate the pile.

7. The pile driving apparatus according to claim 2, wherein said slot is U-shaped and extends from a first edge of said support plate to about the center of said support plate.

8. The pile driving apparatus according to claim 7, further including a gate removably attached to said support plate, said gate being positioned to extend across said slot adjacent said first edge of said support plate.

9. The pile driving apparatus according to claim 2, including two vibratory hammer units fixed to the top of said support plate, said two vibratory hammer units being symmetrically positioned on both sides of said slot, and a synchronization shaft extending between said two vibratory hammer units, whereby said vibratory hammer units act in a synchronized manner to vibrate the pile.

10. The pile driving apparatus according to claim 1, wherein said slot is U-shaped and extends from a first edge of said support plate to about the center of said support plate.

11. The pile driving apparatus according to claim 10, further including a gate removably attached to said support plate, said gate being positioned to extend across said slot adjacent said first edge of said support plate.

12. The pile driving apparatus according to claim 1, including two vibratory hammer units fixed to the top of said support plate, said two vibratory hammer units being symmetrically positioned on both sides of said slot, and a synchronization shaft extending between said two vibratory hammer units, whereby said vibratory hammer units act in a synchronized manner to vibrate the pile.

* * * * *